US008636103B1

(12) United States Patent
Won

(10) Patent No.: US 8,636,103 B1
(45) Date of Patent: Jan. 28, 2014

(54) MUFFLER FOR VEHICLE

(71) Applicant: Hyundai Motor Company, Seoul (KR)

(72) Inventor: Taeho Won, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/681,171

(22) Filed: Nov. 19, 2012

(30) Foreign Application Priority Data

Aug. 10, 2012 (KR) ..... 10-2012-0087688

(51) Int. Cl.
*F01N 1/24* (2006.01)

(52) U.S. Cl.
USPC ..... 181/256; 181/212; 181/237

(58) Field of Classification Search
USPC ..... 181/256, 237, 212
See application file for complete search history.

(56) References Cited

U.S. PATENT DOCUMENTS

| | | | | |
|---|---|---|---|---|
| 4,467,887 | A | 8/1984 | Vizard | |
| 4,484,659 | A * | 11/1984 | Buchwalder | 181/266 |
| 4,846,302 | A * | 7/1989 | Hetherington | 181/243 |
| 4,930,597 | A * | 6/1990 | Udell | 181/256 |
| 5,025,890 | A * | 6/1991 | Hisashige et al. | 181/272 |
| 6,412,596 | B1 * | 7/2002 | Brandt et al. | 181/256 |
| 7,004,283 | B2 * | 2/2006 | Worner et al. | 181/239 |
| 7,325,651 | B2 * | 2/2008 | Kikuchi et al. | 181/237 |
| 8,201,660 | B2 * | 6/2012 | Han et al. | 181/254 |
| 2004/0178015 | A1 * | 9/2004 | Wiemeler et al. | 181/237 |
| 2006/0027420 | A1 * | 2/2006 | Hahnl et al. | 181/283 |

FOREIGN PATENT DOCUMENTS

| | | |
|---|---|---|
| JP | 08-170527 (A) | 7/1996 |
| JP | 2003-3838 A | 1/2003 |
| JP | 2005-212748 A | 8/2005 |
| JP | 2006-233862 (A) | 9/2006 |
| JP | 2012-57610 A | 3/2012 |
| KR | 10-0857304 B1 | 9/2008 |
| KR | 20-2009-0013185 (U) | 12/2009 |
| KR | 10-0962791 B1 | 6/2010 |
| KR | 10-0993649 B1 | 11/2010 |

* cited by examiner

*Primary Examiner* — Forrest M Phillips
(74) *Attorney, Agent, or Firm* — Morgan, Lewis & Bockius LLP

(57) ABSTRACT

A muffler for a vehicle may include a main muffler in front of a rear suspension when viewing from a front of the vehicle, a plurality of baffles dividing an interior of the main muffler into a plurality of chambers, an inlet pipe installed substantially at an center of one side of the main muffler and passing through the plurality of the baffles, a discharge pipe installed at a lower side of the other side of the main muffler and passing through the plurality of the baffles, wherein the discharge pipe exhausts an exhaust gas flowed in the inlet pipe to an exterior of the main muffler, an intermediate pipe in fluidic communication with an outlet port of the inlet pipe, and a variable valve selectively opened or closed in response to a back pressure of the exhaust gas from an outlet port of the intermediate pipe.

8 Claims, 3 Drawing Sheets

MUFFLER FOR VEHICLE

CROSS-REFERENCE(S) TO RELATED APPLICATIONS

The present application claims priority of Korean Patent Application Number 10-2012-0087688, filed on Aug. 10, 2012, the entire contents of which application is incorporated herein for all purposes by this reference.

BACKGROUND OF INVENTION

1. Field of Invention

The present invention relates to a muffler for a vehicle, and particularly to a muffler for a vehicle which makes it possible to minimize oscillation booming noises.

2. Description of Related Art

In order to reduce the noise from exhaust gas, a muffler is generally installed on an exhaust line installed to guide the exhaust gas to the rear side of the vehicle in an exhaust system configured to discharge the exhaust gas generating from the engine of a vehicle.

As shown in FIG. 1, a main muffler 10 of the conventional art is engaged at a rear side of a vehicle, the installation position of which is determined based on a limited lower structure of a vehicle. The installation position of the main muffler 10 inevitably becomes a rear side of a vehicle and is critical in an attempt to avoid any interference with a fuel tank and a suspension. Here, as the main muffler 10 is positioned at a rear side of the vehicle, the prevention of booming becomes hard, and the loss due to insertion is more worsened.

Given the above background, there is a need in the art for an improved main muffler.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention are directed to provide a muffler for a vehicle which features in that a main muffler is installed in front of a rear suspension when viewing from the front side of a vehicle, thus minimizing an oscillation booming noise.

Various aspects of the present invention provide a muffler for a vehicle comprising a main muffler disposed in front of a rear suspension when viewing from a front of the vehicle, a plurality of baffles dividing an interior of the main muffler into a plurality of chambers, an inlet pipe installed substantially at an center of one side of the main muffler and passing through the plurality of the baffles, a discharge pipe installed at a lower side of the other side of the main muffler and passing through the plurality of the baffles, wherein the discharge pipe is provided for exhausting an exhaust gas flowed in the inlet pipe to an exterior of the main muffler, an intermediate pipe in fluidic communication with an outlet port of the inlet pipe, and a variable valve selectively opened or closed in response to a back pressure of the exhaust gas from an outlet port of the intermediate pipe.

The interior of the main muffler may include first, second, third, fourth and fifth chambers which are partitioned by means of first, second, third and fourth baffles. A first array of punched holes, a second array of punched holes and a third array of punched holes may be formed on an outer circumferential surface of the inlet pipe passing through the second chamber, the third chamber and the fourth chamber respectively, and a fourth array of punched holes and a fifth array of punched holes may be formed on an outer circumferential surface of the discharge pipe passing through the first chamber and the second chamber respectively.

The inlet pipe may be configured to pass through the first, second, third and fourth baffles, and the outlet port of the inlet pipe is positioned in the fifth chamber. The discharge pipe may be configured to pass through the first, second, third and fourth baffles, and an inlet port of the discharge pipe is positioned in the first chamber. The intermediate pipe may be positioned in the fourth chamber and pass through the third baffle and the fourth baffle, and may be in fluidic communication with the third chamber and the fifth chamber.

Various aspects of the present invention provide the variable valve that may open when the back pressure of the exhaust gas from the outlet port of the intermediate pipe exceeds a certain pressure level, thereby providing a fluidic communication between the second chamber and the third chamber. The variable valve may remain closed if the back pressure of the exhaust gas from the outlet port of the intermediate pipe is lower than a certain pressure level, thereby forcing an amount of the exhaust gas passing through the first array of punched holes of the inlet pipe and through the fifth array of punched holes of the discharge pipe and then discharged to the exterior of the main muffler.

In addition, glass wool may be filled in the fourth chamber through which the inlet pipe passes. A plurality of flow holes may be formed on the surfaces of the third baffle and the fourth baffle which are configured to partition the fourth chamber. A plurality of flow holes may be formed in the first baffle so that the exhaust gas passing through the variable valve by way of the third chamber can pass through the first chamber.

According to various aspects of the present invention, the main muffler is installed in front of a rear suspension when viewing from the front side of a vehicle, so the length of a shaft can be prolonged, thus increasing the volume and reducing booming noises.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
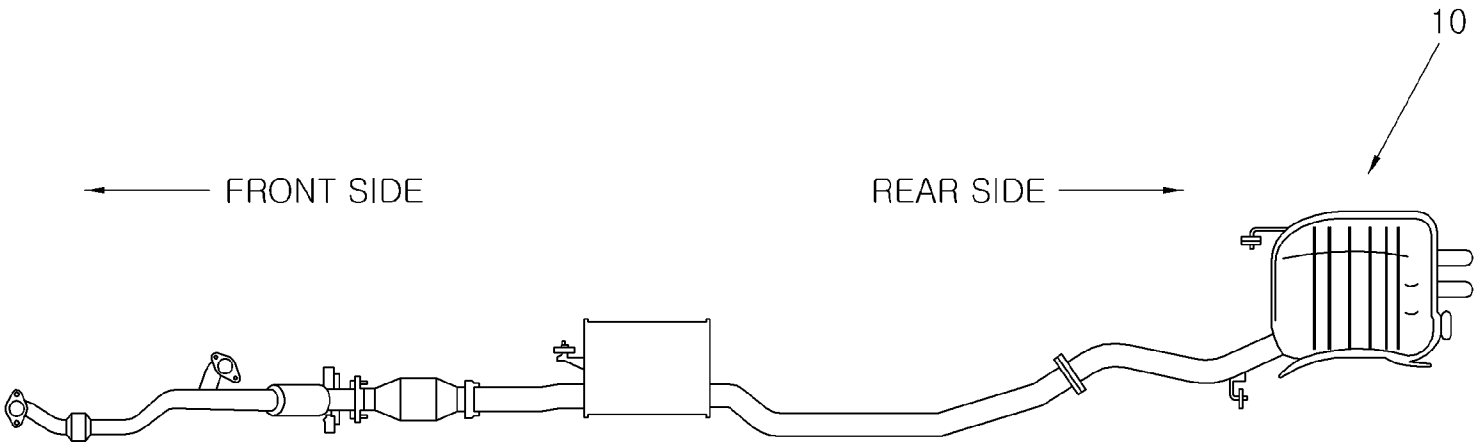
FIG.1 (Prior Art)
FIG. 1 is a view illustrating a conventional muffler for a vehicle.
Figure 2:
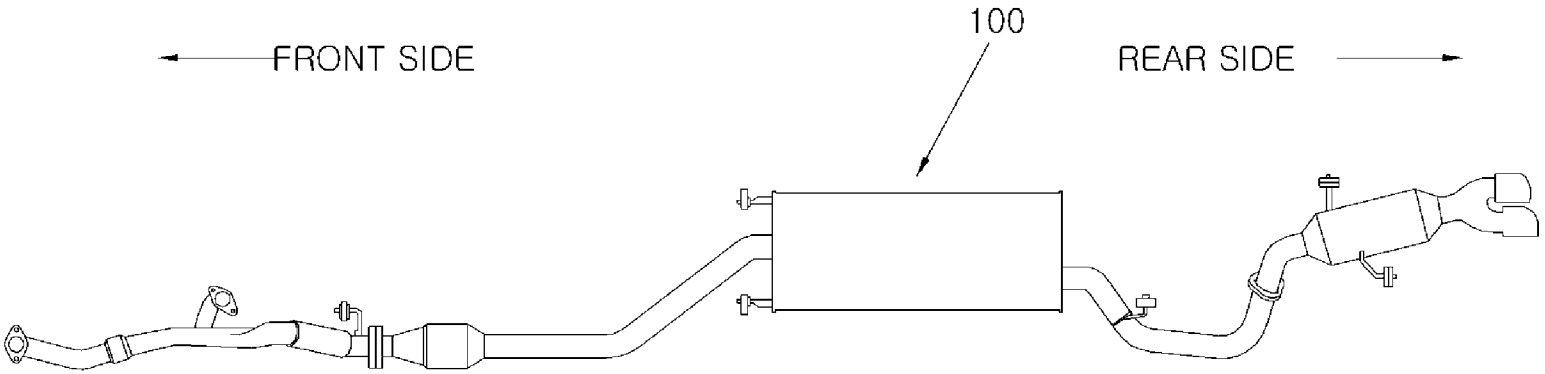
FIG. 2 is a view illustrating an exemplary muffler for a vehicle according to the present invention.

FIG. 2 is a view illustrating an exemplary muffler for a vehicle according to various embodiments of the present invention. As shown in FIG. 2, the muffler for a vehicle according to various embodiments of the present invention comprises a main muffler 100 configured to have a certain volume. The main muffler 100 has a distant portion generally configured to have an elliptical cross section and has a certain length prolonged in a direction that a vehicle drives. In various embodiments, when viewing from the front side of a vehicle, the main muffler 100 may be positioned in front of a rear suspension connected to the rear wheels of a vehicle for absorbing vibrations, the construction of which helps obtain more spaces as compared to the conventional main muffler. As the length of the shaft can be prolonged, larger volume can be obtained. For example, the volume of 33 liters can be obtained, which is greater than 27 liters in the conventional art.

Figure 3:
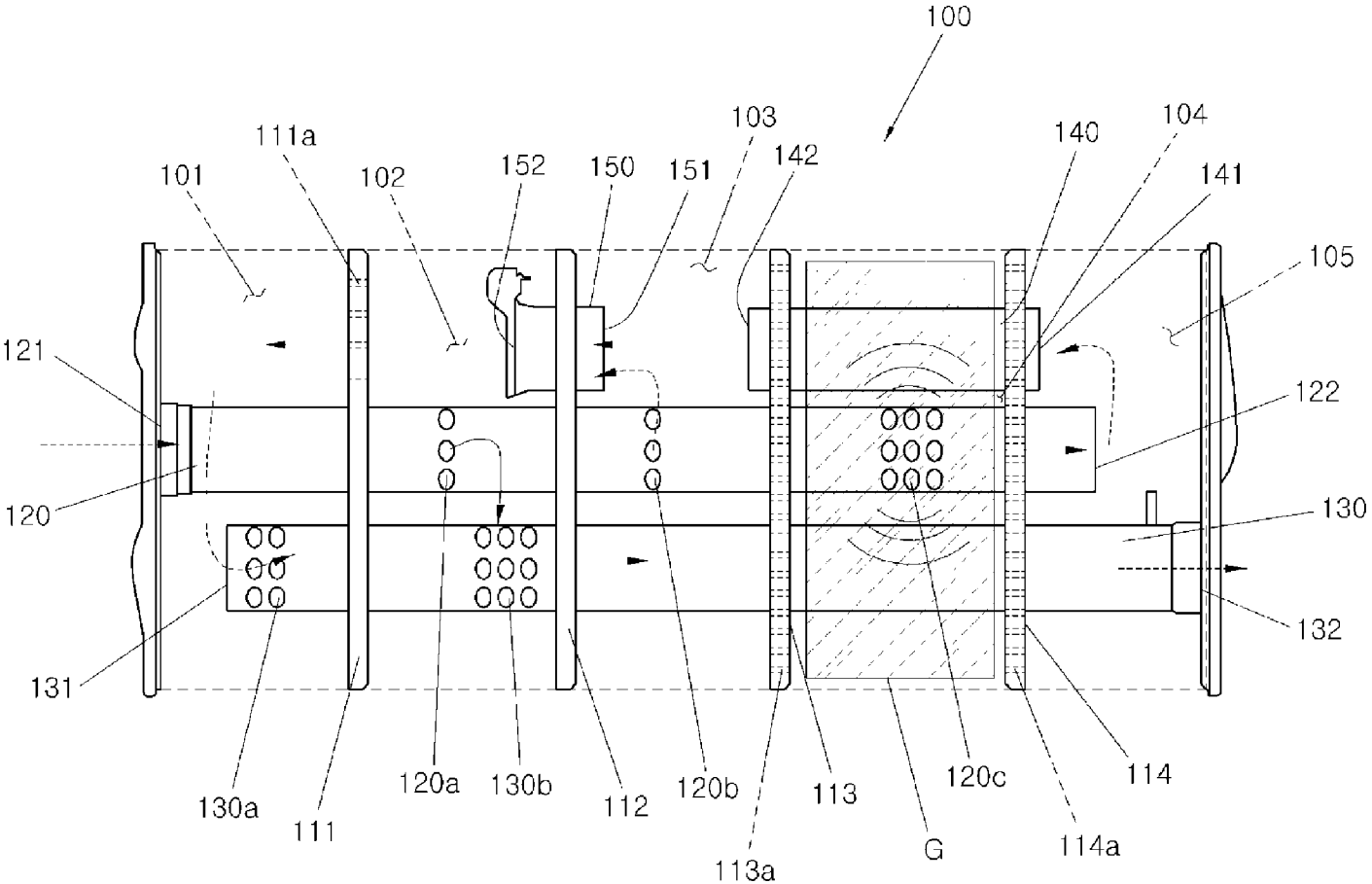
FIG. 3 is a cross sectional view illustrating an exemplary muffler for a vehicle according to the present invention.

FIG. 3 is a cross sectional view illustrating an exemplary muffler for a vehicle according to various embodiments of the present invention. As shown in FIG. 3, a plurality of baffles such as baffles 111, 112, 113, 114 are disposed at substantially regular intervals for the purpose of sectioning the interior of it into a plurality of chambers such as chambers 101, 102, 103, 104, 105. The plurality of the baffles 111, 112, 113, 114 include a first baffle 111, a second baffle 112, a third baffle 113 and a fourth baffle 114. A first chamber 101, a second camber 102, a third chamber 103 and a fourth chamber 104 are respectively formed between the neighboring portions formed from the first baffler 111, the second baffle 112, the third baffle 113 and the fourth baffler 114.

At one side of the main muffler 100, for example, substantially at the center of one side of the main muffler 100 is disposed an inlet pipe 120 which passes from the first chamber 101 to the fifth chamber 105. In other words, the inlet pipe 120 is arranged passing through the first baffle 111, the second baffler 112, the third baffler 113 and the fourth baffle 115. Here, an inlet port 121 of the inlet pipe 120 communicates with an outer side of the main muffler 100, and an outlet port 122 of the input pipe 120 is positioned at the fifth chamber 105.

At the lower side of the other side of the main muffler 100 is arranged a discharge pipe 130 passing from the first chamber 101 to the fifth chamber 105. The discharge pipe 130 is configured to pass the first baffle 111, the second baffler 112, the third baffle 113 and the fourth baffle 114. Here, an inlet port of the discharge pipe 130 is positioned in the interior of the first chamber 101, and an outlet port 132 of the discharge pipe 130 communicates with an outer side of the main muffler 100.

In addition, an intermediate pipe 140 is prolonged from the inlet pipe 120 while communicating with the outlet port 122 through which exhaust gas is discharged. The intermediate pipe 140 is installed in the fourth chamber 104 while passing through the third baffle 113 and the fourth baffle 114, so the third chamber 103 and the fifth chamber 105 come to communicate with each other. In various embodiments, glass wool (G) may be filled in the interior of the fourth chamber 104. Since the main muffler 100 is disposed in front of the rear suspension when viewing from the front side of the vehicle, the temperature of the exhaust gas increases, and the flow speed/turbulent flow energy increases, so the flow-induced noises generate, and the high frequency is more worsened. In various embodiments of the present invention, glass wool (G) is filled in the interior of the fourth chamber 104 in order to improve the above mentioned problems. One would appreciate that other materials similar to glass wool may be used.

A plurality of flow holes such as flow holes 113*a* and 114*a* may be formed on the whole portions of the third baffle 113 and the fourth baffle 114. The formation of the plurality of the flow holes 113*a* and 114*a* may help effectively eliminate the high frequency noises.

At the second baffle 112 is disposed a valve 150 configured to transfer the exhaust gas from the outlet port 142 of the intermediate pipe 140 to the second chamber 102. At a variable valve 150 is disposed a gate 152 which is configured to close during the idle operation of the vehicle and to open when the revolution of the engine increases or the back pressure in the interior of the main muffler 100 increases. As another example, at the variable valve 150 is provided an elastic member with an elastic modulus, with the aid of which the variable valve 150 can open or close depending on the back pressure if the revolution of the engine of the vehicle is lower or higher than a normal range, for example, a revolution of 2500 rpm.

On the outer circumferential surface of the inlet pipe 120 are formed a plurality of punched holes such as punched holes 120*a*, 120*b* and 120*c* which help change the flow of the exhaust gas in each section of the revolution of the engine: the first array of punched holes 120*a* of the inlet pipe 120 passing through the second chamber 102, the second array of punched holes 120*b* of the inlet pipe 120 passing through the third chamber 103, and the third array of punched holes 120*c* of the inlet pipe 120 passing through the fourth chamber 104. Here, the number of the punched holes each passing through a corresponding chamber may vary depending on results of the experiments or other factors.

On the outer circumferential surface of the discharge pipe 130 are formed punched through holes such as punched through holes 130*a* and 130*b*: the fourth array of punched holes 130*a* of the discharge pipe 130 positioned in the first chamber 101, and the fifth array of punched holes 130*b* of the discharge pipe 130 passing through the second camber 102.

The operations of the exemplary muffler for a vehicle according to various embodiments of the present invention will be described.

If the revolution of the engine of a vehicle belongs to a low load section, the exhaust gas is introduced by way of the inlet pipe 120 and moves toward the variable valve 150 by way of the inlet port 141 of the intermediate pipe 140 in the fifth chamber 105. Here, due to the low pressure of the exhaust gas, the gate 152 of the variable valve 150 keeps closed, so a small amount or some amount of the exhaust gas is forced to pass through the first array of punched holes 120*a* of the inlet pipe 120 in the second chamber 102 and to discharge to the outside by way of the fifth array of punched holes 130*b* of the discharge pipe 130. In addition, the first chamber 101 and the second chamber 102 are formed like a resonance chamber, the construction of which helps reduce the booming noises, such as the booming noises of 110 Hz.

If the revolution of the engine of a vehicle belongs to a high load section, the high pressure exhaust gas passes through the outlet port 122 of the inlet pipe 120 and reaches the variable valve 150 by way of the inlet port 141 of the intermediate pipe 140. At this time, since an external force exceeding the elastic force is generated and applied due to the pressure of the exhaust gas within the elastic modulus of the elastic member of the variable valve 150, the gate 152 is forced to open. Afterward, the exhaust gas flows into the first chamber 101 by way of the flow hole 111*a* formed at a partial portion of the first baffle 111 and flows toward the discharge pipe 130 by way of the inlet port 131 of the discharge pipe 130 in the first chamber 101 and the fourth array of punched holes 130*a* and then is discharged to the outside. At this time, due to the construction that the main muffler 100 is positioned in front of the rear suspension when viewing from the front side of the vehicle as compared to the conventional art, the temperature of the exhaust gas is high, and the flow speed/turbulent flow energy increases, the operations of which might worsen the flow-induced noises and the high frequency noises; however such noises are reduced while the exhaust gas passes through the glass wool G filled in the fourth chamber 104 and a plurality of the flow holes 113*a* and 114*a* formed on the whole surfaces of the third baffle 113 and the fourth baffle 114.

For convenience in explanation and accurate definition in the appended claims, the terms "interior" or "exterior", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A muffler for a vehicle, comprising:

a main muffler disposed in front of a rear suspension when viewing from a front of the vehicle;

a plurality of baffles dividing an interior of the main muffler into a plurality of chambers;

an inlet pipe installed substantially at an center of one side of the main muffler and passing through the plurality of the baffles;

one discharge pipe installed parallel to the inlet pipe in the main muffler and passing through the plurality of the baffles, wherein the discharge pipe is provided for exhausting an exhaust gas flowed in the inlet pipe to an exterior of the main muffler;

an intermediate pipe installed in the main muffler and having an inlet port disposed in a chamber that is the same as an outlet port of the inlet pipe; and a variable valve selectively opened or closed in response to a back pressure of the exhaust gas from an outlet port of the intermediate pipe;

wherein the plurality of chambers includes first, second, third, fourth and fifth chambers that are partitioned by means of first, second, third and fourth baffles;

wherein the inlet pipe includes a first array of punched holes, a second array of punched holes and a third array of punched holes that are formed on an outer circumferential surface of the inlet pipe passing through the second chamber, the third chamber and the fourth chamber, respectively;

wherein the discharge pipe includes a fourth array of punched holes and a fifth array of punched holes that are formed on an outer circumferential surface of the discharge pipe passing through the first chamber and the second chamber, respectively;

wherein the fourth chamber, through which the inlet pipe passes, is filled with glass wool; and wherein the third array of punched holes formed on the outer circumferential surface of the inlet pipe in the fourth chamber allows the exhaust gas in the inlet pipe to flow toward flow holes of the fourth baffle through the glass wool.

2. The muffler of claim 1, wherein the inlet pipe is configured to pass through the first, second, third and fourth baffles, and the outlet port of the inlet pipe is positioned in the fifth chamber.

3. The muffler of claim 1, wherein the discharge pipe is configured to pass through the first, second, third and fourth baffles, and an inlet port of the discharge pipe is positioned in the first chamber.

4. The muffler of claim 1, wherein the intermediate pipe is positioned in the fourth chamber and passes through the third baffle and the fourth baffle, and is in fluidic communication with the third chamber and the fifth chamber.

5. The muffler of claim 1, wherein the variable valve opens when the back pressure of the exhaust gas from the outlet port of the intermediate pipe exceeds a certain pressure level, thereby providing a fluidic communication between the second chamber and the third chamber.

6. The muffler of claim 1, wherein the variable valve keeps closed if the back pressure of the exhaust gas from the outlet port of the intermediate pipe is lower than a certain pressure level, thereby forcing an amount of the exhaust gas passing through the first array of punched holes of the inlet pipe and through the fifth array of punched holes of the discharge pipe and then discharged to the exterior of the main muffler.

7. The muffler of claim 1, wherein a plurality of flow holes are formed on the surfaces of the third baffle and the fourth baffle which are configured to partition the fourth chamber.

8. The muffler of claim 1, wherein a plurality of flow holes are formed in the first baffle so that the exhaust gas passing through the variable valve by way of the third chamber can pass through the first chamber.

* * * * *